US011268762B2

(12) United States Patent
Ebner et al.

(10) Patent No.: US 11,268,762 B2
(45) Date of Patent: Mar. 8, 2022

(54) GAS-CUSHION-TYPE STRIP-SUPPORTING SYSTEM HAVING A NOZZLE SYSTEM

(71) Applicant: EBNER INDUSTRIEOFENBAU GMBH, Leonding (AT)

(72) Inventors: Robert Ebner, Leonding (AT); Ulrich Pschebezin, Ansfelden (AT); Roland Lukatsch, Hartkirchen (AT); Alexander Pocherdorfer, Walding (AT); Günther Fröhlich, Sonnberg i. M. (AT); Leopold Götsch, Linz (AT)

(73) Assignee: EBNER INDUSTRIEOFENBAU GMBH, Leonding (AT)

( * ) Notice: Subject to any disclaimer, the term of this patent is extended or adjusted under 35 U.S.C. 154(b) by 281 days.

(21) Appl. No.: 16/490,768

(22) PCT Filed: Mar. 6, 2018

(86) PCT No.: PCT/EP2018/055464
§ 371 (c)(1),
(2) Date: Sep. 3, 2019

(87) PCT Pub. No.: WO2018/162474
PCT Pub. Date: Sep. 13, 2018

(65) Prior Publication Data

US 2020/0025445 A1 Jan. 23, 2020

(30) Foreign Application Priority Data

Mar. 8, 2017 (DE) ..... 10 2017 104 909.6

(51) Int. Cl.
*F27B 9/24* (2006.01)
*C22F 1/04* (2006.01)
(Continued)

(52) U.S. Cl.
CPC ..... *F27B 9/2476* (2013.01); *C22F 1/04* (2013.01); *C22F 1/08* (2013.01); *F27B 9/28* (2013.01); *F27B 9/30* (2013.01)

(58) Field of Classification Search
CPC ... C21D 9/63; C21D 9/573; C22F 1/04; C22F 1/08; F27B 9/2476; F27B 9/28; F27B 9/30
See application file for complete search history.

(56) References Cited

U.S. PATENT DOCUMENTS 4,401,484 A * 8/1983 Yoshimoto ..... C21D 9/63 148/657
4,785,985 A 11/1988 Hurtgen
(Continued)

FOREIGN PATENT DOCUMENTS

CN 1208168 A 2/1992
CN 1137635 A 12/1996
(Continued)

*Primary Examiner* — Scott R Kastler
(74) *Attorney, Agent, or Firm* — Lewis Roca Rothgerber Christie LLP

(57) ABSTRACT

A nozzle system for a band floating system for floatingly guiding a band-shaped material having a nozzle body having a front edge area and a rear edge area opposite to the front edge area, a front gas nozzle arrangement arranged at the front edge area, a rear gas nozzle arrangement arranged at the rear edge area, and a nozzle arrangement arranged, in the conveying direction, in front of the front gas nozzle arrangement and/or behind the rear gas nozzle arrangement such that a liquid fluid is flowable in a fluid jet into a nozzle floating field in the direction towards a band running plane for temperature-controlling the band-shaped material.

13 Claims, 2 Drawing Sheets

(51) Int. Cl.

| | |
|---|---|
| ***C22F 1/08*** | (2006.01) |
| ***F27B 9/28*** | (2006.01) |
| ***F27B 9/30*** | (2006.01) |

(56) References Cited

U.S. PATENT DOCUMENTS

| | | | | |
|---|---|---|---|---|
| 5,616,295 | A | 4/1997 | Tawara et al. | |
| 6,091,055 | A | 7/2000 | Naka et al. | |
| 10,619,924 | B2 | 4/2020 | Ylimäinen | |
| 2003/0047642 | A1 | 3/2003 | Ebner | |
| 2004/0154182 | A1 | 8/2004 | Kramer | |
| 2017/0321298 | A1* | 11/2017 | Baukloh | C21D 9/63 |
| 2020/0025445 | A1* | 1/2020 | Ebner | C21D 9/573 |

FOREIGN PATENT DOCUMENTS

| | | | |
|---|---|---|---|
| CN | 1440360 | A | 9/2003 |
| CN | 101454466 | A | 6/2009 |
| CN | 201949931 | U | 8/2011 |
| CN | 203360520 | U | 12/2013 |
| CN | 210711639 | U | 6/2020 |
| DE | 103 03 228 | B3 | 4/2004 |
| DE | 10 2006 032 377 | A1 | 1/2008 |
| DE | 10 2014 118 946 | A1 | 6/2016 |
| DE | 202016101584 | U1 | 6/2016 |
| EP | 0 192 169 | B1 | 10/1990 |
| JP | S50-1 10492 | U | 9/1975 |
| JP | S52-24015 | U | 2/1977 |
| JP | S56-102526 | A | 8/1981 |
| JP | 56-142829 | A | 11/1981 |
| JP | S5848641 | A | 3/1983 |
| JP | 558-151429 | A | 9/1983 |
| JP | S6043434 | A | 3/1985 |
| JP | 61-253329 | A | 11/1986 |
| JP | 61-295331 | A | 12/1986 |
| JP | S61295330 | A | 12/1986 |
| JP | S62-4833 | A | 1/1987 |
| JP | H08-283875 | A | 10/1996 |
| JP | 2008-283875 | A | 11/2008 |
| WO | WO 2016/096173 | A1 | 6/2016 |

* cited by examiner

GAS-CUSHION-TYPE STRIP-SUPPORTING SYSTEM HAVING A NOZZLE SYSTEM

REFERENCE TO RELATED APPLICATIONS

The present application is a national phase application derived from the international patent application no. PCT/EP2018/055464, filed Mar. 6, 2018, which in turn claims the benefit of the filing date of the German patent application no. DE 10 2017 104 909.6, filed Mar. 8, 2017, both of which are incorporated herein by reference in their entirety.

TECHNICAL AREA

The present invention relates to a nozzle system for a band floating system for floatingly guiding a band-shaped material as well as a band floating system. Furthermore, the present invention relates to a method of floatingly guiding a band-shaped material.

BACKGROUND OF THE INVENTION

In the manufacturing of metal component parts, and in particular of metal bands, these component parts are temperature-controlled targetedly (or selectively) in order to adjust a desired metal microstructure in the final product. Herein, metal bands are guided continuously or sequentially through a band floating oven (or gas-cushion-type band-supporting oven). Herein, the individual sections of the band floating oven can be heated and/or cooled individually with a desired temperature. During the passage through the band floating oven, the metal band to be temperature-controlled undergoes a predefined temperature-control progression (or course) such that a desired metal microstructure is adjustable.

In band floating ovens, the metal band is guided therethrough floatingly (or in a floating manner), i.e. contactless. For this purpose, in particular air nozzles are arranged, which form a nozzle floating field (or a gas-cushion supporting field) and lift the metal band.

For cooling the metal band, this is wetted (or moistened) with a liquid, in particular water. Herein, the optimum alignment (or orientation) of the water nozzles as well as the water quantity are of significance in order to adjust a desired cooling gradient. In particular, it has turned out to be advantageous that the metal band can be cooled gently (or conservingly) by evaporation cooling. Herein, it is tried that the cooling medium (water), which is applied onto the surface to be cooled, evaporates completely. If no complete evaporation occurs, there is the risk of droplet formation on the surface of the metal band. These droplets and/or this residual water cool the metal band inhomogeneously, e.g. locally stronger, such that no homogeneous cooling is ensured.

Presentation of the Invention

There may be need to adjust a band floating system with a precisely adjustable cooling gradient for a material to be guided.

According to exemplary embodiments of the invention, there is provided a nozzle system for a band floating system, a band floating system for floatingly guiding a band-shaped material as well as a method for floatingly guiding a band-shaped material according to the subject-matter of the independent claims.

According to a first aspect of the invention, there is described a nozzle system for a band floating system (or gas-cushion-type band-supporting system) for floatingly guiding a band-shaped (or strip-shaped) material. The nozzle system has a nozzle body, which has, along a conveying direction of the band-shaped material, which is conveyable within a band running plane, a front edge area (or front border area) and a rear edge area (or rear border area) opposite to the front edge area. Furthermore, the nozzle system has a front gas nozzle arrangement, which is arranged at the front edge area such that a front gas jet is flowable (or can be flown) in the direction towards the band running plane for forming a nozzle floating field (or gas-cushion supporting field) for the band-shaped material. Furthermore, the nozzle system has a rear gas nozzle arrangement, which is arranged at the rear edge area such that a rear gas jet is flowable in the direction towards the band running plane for forming the nozzle floating field for the band-shaped material. Furthermore, the nozzle system has a nozzle arrangement, which is arranged in the conveying direction in front of the front gas nozzle arrangement and/or behind the rear gas nozzle arrangement, in particular at the nozzle body and/or at a supporting structure that is structurally separated from the nozzle body. The nozzle arrangement is adjusted such that a liquid fluid is flowable in a fluid jet in the direction towards the band running plane into the nozzle floating field for temperature-controlling the band-shaped material.

According to a further aspect of the present invention, there is described a method for floatingly guiding a band-shaped material. According to the method, the band-shaped material is guided along a conveying direction within a band running plane, wherein a nozzle body has, along a conveying direction, a front edge area and a rear edge area opposite to the front edge area. Furthermore, a front gas jet is flown in the direction towards the band running plane for forming a nozzle floating field for the band-shaped material by a front gas nozzle arrangement, which is arranged at the front edge area. Furthermore, a rear gas jet is flown in the direction towards the band running plane for forming the nozzle floating field for the band-shaped material by a rear gas nozzle arrangement, which is arranged at the rear edge area. Furthermore, a fluid jet is flown into the nozzle floating field into the direction of the band running plane for temperature-controlling the band-shaped material by a nozzle arrangement, which is arranged in the conveying direction in front of the front and/or behind the rear gas nozzle arrangement.

The band-shaped (or strip-shaped) material may consist for example of a thin metal band (or metal strip), such as for example consisting of a non-ferrous material (or copper and copper alloys) or aluminium. In the band floating system (or gas-cushion-type band-supporting system), the band-shaped material may be conveyed almost contactless, such that locations of contact (or contact areas) may be reduced. In particular, this may be generated by the generation of a nozzle floating field by the gas nozzle arrangement. In other words, the band-shaped material may be supported by the nozzle floating field.

The band-shaped material may be guided within a band running plane. Furthermore, the band-shaped material may be guided in a conveying direction through the band floating system. The width of the band-shaped material may be defined perpendicular and/or transverse to the conveying direction.

The nozzle body may form for example a nozzle box. The nozzle body may support the gas nozzle arrangements. Furthermore, the nozzle arrangement for flowing out the liquid fluid may be attached to and/or arranged at the nozzle body. The nozzle arrangement may also be arranged at a supporting structure that may be structurally separated from the nozzle body. The nozzle body may, for example, integrally form for example the gas nozzle arrangement. For example, as is described further below, corresponding gas nozzle arrangements may be formed by round or slot-type outlets. The nozzle body may further extend across the width of the band-shaped material and/or perpendicular to the conveying direction.

The nozzle body may be defined (or delimited), in the conveying direction, by a front edge, which may form the front edge area (or front border region), and a rear edge, which may form the rear edge area (or rear border region). The front edge and the rear edge may herein be formed in particular parallel to each other and lying opposite to each other at the nozzle body. The front gas nozzle arrangement may thus be arranged at the nozzle body oppositely to the rear gas nozzle arrangement. Between the gas nozzle arrangement, there may be arranged in particular no nozzle arrangement for flowing out a liquid fluid. The front edge area and the rear edge area may extend over the width and/or in the width direction of the band-shaped material. The front gas nozzle arrangement may be arranged and/or formed along the front edge area. Herein, the front gas nozzle arrangement may have, for example, a plurality of individual gas nozzles, or may be formed by corresponding outlets in the front edge area. The rear gas nozzle arrangement may herein have, for example, a plurality of individual gas nozzles, or may be formed by corresponding outlets in the rear edge area. The front and rear gas nozzle arrangements may be formed to flow a gaseous medium, i.e. a gas and/or a gas mixture, by one or more front and rear gas jets in the direction towards the band running plane.

For example, air, noble gases and/or other inert gases may be used for generating the front and the rear gas jet.

The gas nozzle arrangements may herein be formed such that the volume flow and the gas pressure of the respective front and rear gas jets may generate an according stable nozzle floating field (or gas-cushion supporting field). The nozzle floating field may serve to deflect and/or align the band-shaped material. On the one hand, a lower nozzle floating field, which may be formed below the band-shaped material, may lift the band-shaped material. Furthermore, a nozzle floating field, which may be formed above the band-shaped material, may move and/or deflect the band-shaped material in the gravitation direction.

The nozzle arrangement may be formed to spray a liquid fluid, such as for example a water mixture or an oil mixture, into the nozzle floating field in the direction towards the band running plane in order to effect a desired temperature-control effect (heating or cooling) of the band-shaped material. Herein, the nozzle arrangement may spray the liquid fluid with a predefined volume flow as well as a predefined fluid temperature into the nozzle floating field in the direction towards the band running plane. The nozzle arrangement may extend across the width of the band-shaped material and may form a so-called water beam (or water scantling).

Herein, the nozzle arrangement may be formed such that the liquid fluid can be flown out with a high degree of dispersion, i.e. with a small droplet size, into the nozzle floating field in the direction towards the band running plane. The nozzle arrangement may consist of a plurality of nozzle elements, which may be arranged in one or more rows relative to each other and which rows may extend in the width direction perpendicular to the conveying direction.

Due to the additional flow feed (or on-flow) of the band-shaped material by a liquid fluid, for example a heat transmission gradient and/or temperature gradient between 100 Watt/($m^2$×Kelvin) to 6000 Watt/($m^2$×Kelvin) can be adjusted. By the nozzle arrangement, for example the nozzle heads formed therein, the liquid fluid may be dispersed in finest droplets, whereby the evaporation enthalpy may be used as an additional cooling energy.

The gas nozzle arrangements and/or the nozzle arrangement may have, for example, flat jet nozzles, full-cone nozzles, vaporizer nozzles or hollow cone nozzles. Furthermore, corresponding control valves may be provided for the control of the gas nozzle arrangements and/or the nozzle arrangement. Pulse-controlled valves may be arranged in particular for the nozzle arrangement in order to flow the liquid fluid pulsedly, i.e. by a pulsating fluid jet, onto the band-shaped material.

The nozzle arrangement may be arranged in particular outside of the gas nozzle arrangement, i.e. in front of the front gas nozzle arrangement or behind the rear gas nozzle arrangement. In other words, an intermediate area may be formed between the front gas nozzle arrangement and the rear gas nozzle arrangement, which intermediate area may be free from a nozzle arrangement for flowing-in a liquid fluid. Thus, there may be no alternating interleaving of the gas nozzle arrangement with the nozzle arrangement present.

In other words, no fluid nozzle for applying and/or flowing-out a liquid, such as for example water, may be provided between the front edge area of the nozzle body and the rear edge area of the nozzle body. An in-flowing of water between two air nozzles attached at a nozzle body could result in that the water that may be applied by the nozzle can evaporate and escape slower, because the water may escape difficultly from between the two air nozzles and/or the nozzle floating field generated thereby.

According to the approach of the present invention, a liquid, such as for example water, which may be applied by the nozzle arrangement in the conveying direction in front of the front gas nozzle arrangement or behind the rear gas nozzle arrangement, may be discharged (or conveyed away) speedily and advantageously in particular with the help of the nozzle floating field generated by the gas nozzle arrangements, such that an excessive droplet formation at the band-shaped material may be avoided, and accordingly no difficulty of suffering frost (or chill) may occur. The advantageous discharging of the water droplets may be generated in particular by the nozzle arrangement being arranged in the conveying direction of the material in front of the nozzle arrangement at the nozzle body. In other words, an improved drying effect may be effected, because for example the water residuals are blown off by the back-flowing air. Furthermore, an in-flow (or ingress) of the liquid fluid into the gas nozzle arrangement may be prevented.

According to a further exemplary embodiment, the nozzle arrangement may be arranged such that the fluid jet is flowable into the front gas jet, in particular before the front gas jet may strike (or impinge) on the band-shaped material. In other words, the front gas jet and the fluid jet may be formed relative to each other such that the liquid fluid may be mixed with the gas in the front gas jet, before the liquid fluid and the gas may impinge on the band-shaped material. This may result in an improved atomization (or nebulization, or spraying) of the liquid fluid and thus to a more effective temperature-control of the band-shaped material.

According to a further exemplary embodiment, the nozzle arrangement may be arranged such that the fluid jet may form an angle between ±20° and ±85°, in particular between ±30° and ±45°, relative to the conveying direction. Accordingly, the liquid fluid may be applied on the band-shaped material against the conveying direction or with the conveying direction. If the fluid jet forms for example a spraying cone, the angle may be defined between the symmetry axis and/or the middle axis of the spraying cone and the conveying direction. It has turned out that, with the indicated values, the liquid fluid may be applied in an advantageous manner onto the surface of the band-shaped material with a high temperature gradient.

According to a further exemplary embodiment, the front gas nozzle arrangement may be arranged such that the front gas jet forms an angle between 30° and 85°, in particular 45° and 70°, relative to the conveying direction. Thus, the gas may be applied onto the band-shaped material in particular against the conveying direction. If the front gas jet forms for example a cone, then the angle may be defined between the symmetry axis and/or middle axis of the cone and the conveying direction. It has turned out that, with the indicated values, a robust nozzle floating field may be formed in an advantageous manner, and at the same time the liquid fluid may be discharged speedily and completely.

According to a further exemplary embodiment, an angle between the front gas jet and the conveying direction may be larger than an angle between the fluid jet and the conveying direction. In other words, the fluid jet of the liquid fluid may impinge more flat-angledly (or more shallowly) onto the surface of the material than the gas jet. This may result in that a better and/or more laminar (or more areal) contact between the liquid fluid and the material may be generated, and at the same time a more robust nozzle floating field may be generated due to the steeper spraying angle of the gas jet.

According to a further exemplary embodiment, the rear gas nozzle arrangement may be arranged such that the rear gas jet may form an angle between 90° and 175°, in particular between 110° and 135°, relative to the conveying direction. Thus, the gas may be applied onto the band-shaped material in particular in the conveying direction. If the rear gas jet forms for example a cone, then the angle may be defined between the symmetry axis and/or the middle axis of the cone and the conveying direction. It has turned out that, with the indicated values, a robust nozzle floating field may be formed in an advantageous manner, and at the same time the liquid fluid may be discharged speedily and completely.

According to a further exemplary embodiment, the nozzle arrangement may be arranged at the nozzle body such that an angle between the fluid jet and the conveying direction may be adjustable. The nozzle arrangement may be arranged rotatably (or pivotingly) at the nozzle body or at a separate supporting structure, for example by a hinge (or articulation). Herein, the nozzle arrangement may be rotatable in particular about a rotation axis, which may be formed perpendicular to the conveying direction along a width direction of the band-shaped material. As a function of the adjusted spraying angle of the liquid fluid, the temperature-control effect thereof and the formation behaviour of droplets on the band-shaped material may be adjusted. The re-adjustment of the nozzle arrangement may be effected manually. Furthermore, the re-adjustment of the nozzle arrangement may be performed for example by hydraulic, pneumatic or electric drive elements.

According to a further exemplary embodiment, as described above, the front gas nozzle arrangement and/or the rear gas nozzle arrangement may be formed as a slot nozzle (or slit nozzle), which may extend perpendicular to the conveying direction, in particular along the width direction of the band-shaped material.

According to a further exemplary embodiment, the nozzle arrangement may have a plurality of nozzles (in particular nozzle heads), which may be arranged one behind the other along a width of the nozzle body (and/or along the width of the band-shaped material) perpendicular to the conveying direction. The nozzles of the nozzle arrangement, which may extend along the width direction and may be arranged one behind the other, may be controlled for example individually, such that each single nozzle of the nozzle arrangement may flow a defined volume flow of the fluid in the direction towards the band-shaped material. Thus, a desired temperature-control effect may be adjusted across the width of the band-shaped material selectively (or targetedly) and individually. In other words, individual nozzles of the nozzle arrangement may be activated and de-activated (and/or controlled) along the width direction in order to adjust a desired temperature-control effect in the width direction.

According to a further exemplary embodiment, the nozzle system may further have a further nozzle arrangement, which may be arranged in the conveying direction behind the rear gas nozzle arrangement, wherein the further nozzle arrangement may be configured such that a liquid fluid may be flowable in a further jet in the direction towards the band running plane for temperature-controlling the band-shaped material. The further nozzle arrangement may be attached to the nozzle body for example also rotatably. Furthermore, a further nozzle jet of the further nozzle arrangement may be formed such that the liquid fluid may be flown onto the band-shaped material in the direction of the conveying direction.

According to a further exemplary embodiment, the nozzle body may have, between the front edge area and the rear edge area, a perforated metal sheet, through which perforated metal sheet a gaseous fluid may be flowable in the direction towards the band running plane. Herein, the gaseous fluid may be flown through the perforated metal sheet almost perpendicularly onto the band-shaped material. This may result in a formation of a robust nozzle floating field.

According to a further aspect of the present invention, there is described a band floating system (or gas-cushion-type band-supporting system) for floatingly guiding a band-shaped material. The band floating system has a first nozzle system according to the embodiment described above, and a second nozzle system according to the embodiment described above. The first nozzle system is arranged relatively to the second nozzle system such that the band-shaped material is guidable between the first nozzle system and the second nozzle system. Thus, a nozzle floating field (or gas-cushion supporting field) can act on the band-shaped material from both sides, i.e. from below and from above, such that a robust and precise guiding is enabled. Furthermore, a precise temperature-control can be provided on both sides of the band-shaped material.

According to a further exemplary embodiment, the first nozzle system may be arranged located, in the conveying direction, at a distance from the second nozzle system.

According to a further exemplary embodiment, the first nozzle system and the second nozzle system may be configurable such that by a nozzle floating field of the first nozzle system and a nozzle floating field of the second nozzle system, a wave-like (or undulating) (sinus-shaped) course (or progression) of the band-shaped material along the conveying direction may be generatable. According to the exemplary embodiment, two or more nozzle systems according to the type described above may be arranged located at a distance in the conveying direction and alternatingly above and below the band-shaped material. Thus, respectively alternatingly in the conveying direction, a nozzle floating field may lift the band-shaped material, while a subsequent nozzle floating field may push the band-shaped material in the gravitation direction. Thus, a wave-like course of the band-shaped material may be generated selectively in the longitudinal direction and/or in the conveying direction. The formation of a wave-like course of the band-shaped material may result in an increased stability against a bending (or flection) along the width direction of the band-shaped material.

Furthermore, in a further exemplary embodiment, the first nozzle system and the second nozzle system may be arranged adjustably relative to each other in the conveying direction. For example, a distance between the nozzle systems may be adjusted variably. Furthermore, in a further exemplary embodiment, the distance between the nozzle body (and accordingly the gas nozzle arrangements and the nozzle arrangement) and the band-shaped material and/or the band running plane may be adjusted flexibly.

By the present invention, in particular the nozzle arrangement for spraying-on the liquid fluid may be formed such that the influencing parameters, which may influence the cooling behaviour and/or the cooling power of the liquid fluid, i.e. the spraying angle, the nozzle pressure and the volume flow (as a function of type and pressure), may be adjustable variably. In other words, the average heat transmission coefficient may be controlled by the above-described influencing parameters. Herein, the flow of air mass of the air/gas nozzle arrangement may be continuously present due to the necessary supporting effect of the band-shaped material. The liquid fluid may be switched on in order to yield an increase of the heat transmission.

It is pointed out that the embodiments described herein represent only a limited selection of possible embodiment variants of the invention. Thus, it is possible to combine the features of individual embodiments with one another in a suitable manner, such that for the skilled person, with the embodiment variants that are explicit herein, a plurality of different embodiments is be considered as obviously disclosed. In particular, some embodiments of the invention are described by device claims and other embodiments of the invention are described by method claims. However the skilled person will understand upon reading this application that, unless it is explicitly indicated differently, in addition to a combination of features, which belong to one type of invention subject, also an arbitrary combination of features, which belong to different types of invention subjects, are possible.

SHORT DESCRIPTION OF THE DRAWINGS

In the following, embodiment examples of the present invention are described in more detail for a further explanation and a better understanding with reference to the appended drawings.

DETAILED DESCRIPTION OF EXEMPLARY EMBODIMENTS

Figure 1:
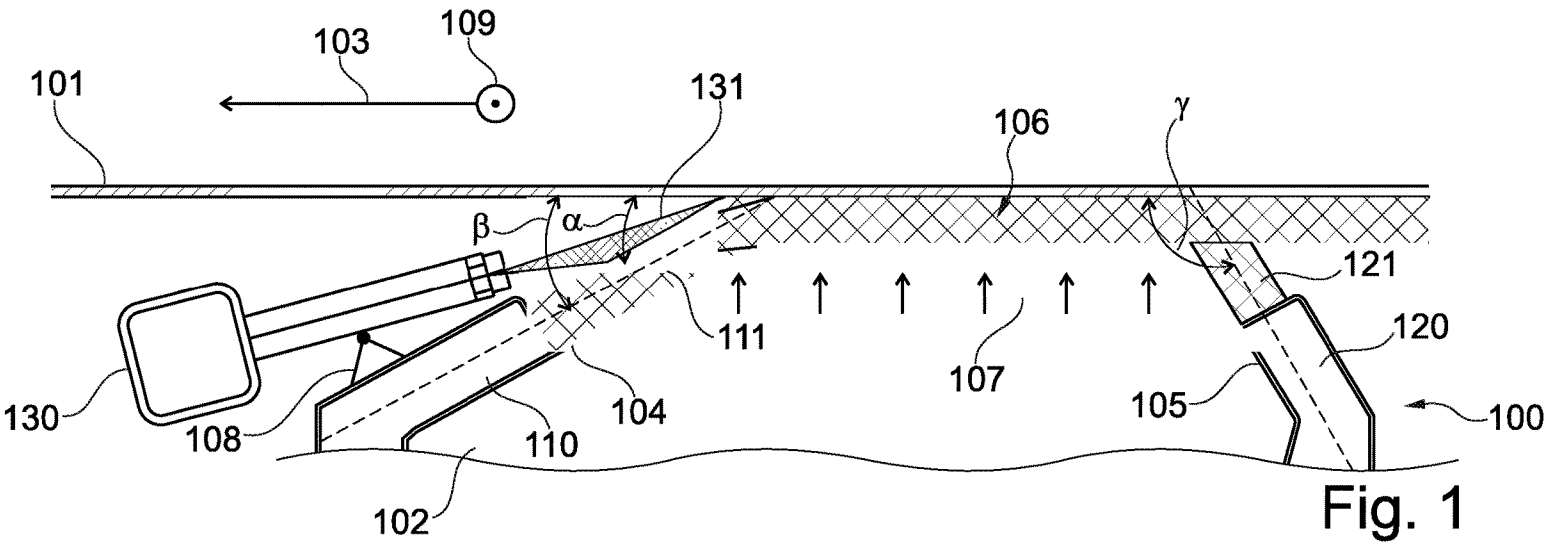
FIG. 1 shows a schematic illustration of a nozzle system for a band floating system, according to an exemplary embodiment of the present invention.

Same or similar components in different figures are provided with same reference numerals. The illustrations in the figures are schematic.

FIG. 1 shows a nozzle system 100 for a band floating system 300 (see FIG. 3) according to an exemplary embodiment of the present invention. The nozzle system 100 may have has a nozzle body 102, which may have, along a conveying direction 103 of the band-shaped material 101, which may be conveyable within a band running plane, a front edge region 104 and a rear edge region 105 opposite to the front end region. The nozzle system 100 may further have a front gas nozzle arrangement 110, which may be arranged at the front edge region 104, such that a front gas jet 111 may be flowable in the direction towards the band running plane for forming a nozzle floating field 106 for the band-shaped material 101. The nozzle system 100 may further have a rear gas nozzle arrangement 120, which may be arranged at the rear edge region 105, such that a rear gas jet 121 may be flowable in the direction towards the band running plane for forming the nozzle floating field 106 for the band-shaped material 101. The nozzle system 100 may further have a nozzle arrangement 130, which may be arranged, in the conveying direction 103, in front of the front gas jet arrangement 110, wherein the nozzle arrangement 130 may be configured such that a liquid fluid may be flowable in a fluid jet 131 into the nozzle floating field 106 in the direction towards the band running plane for temperature-controlling the band-shaped material. Additionally or alternatively, the nozzle arrangement 130 or a further nozzle arrangement may be arranged behind the rear gas nozzle arrangement 120.

The band-shaped material 101 may be guided within a band running plane. Furthermore, the band-shaped material 101 may be guided in the conveying direction 103 by the band floating system 300. The width of the band-shaped material 101 may be defined perpendicular and/or transverse to the conveying direction 103.

The nozzle body 102 may form for example a nozzle box. The nozzle body 102 may support the gas nozzle arrangements 110, 120. Furthermore, in the represented embodiment example, the nozzle arrangement 130 for flowing-out the liquid fluid may be fixed to the nozzle body 102.

In the exemplary embodiment, the nozzle body 102 may form integrally the gas nozzle arrangements 110, 120. For example, corresponding gas nozzle arrangements 110, 120 may be formed by slot-type outlets. The nozzle body 102 may further extend across the width 109 of the band-shaped material 101 and/or perpendicular to the conveying direction 103.

The nozzle body 102 may be defined in the conveying direction 103 by a front edge region 104 and a rear edge region 105. The front edge region 104 and the rear edge region 105 may extend across the width 109 of the band-shaped material 101. The front gas nozzle arrangement 110 may be arranged and/or formed along the front edge region 104.

The front and rear gas nozzle arrangements 110, 120 may be formed to flow a gaseous medium, i.e. a gas and/or a gas mixture, by one or more front and rear gas jets in the direction towards the band running plane.

Herein, the gas nozzle arrangements 110, 120 may be formed such that the volume flow and the gas pressure of the corresponding front and rear gas jets 111, 121 may generate a corresponding stable nozzle floating field 106. The nozzle floating field 106 may serve to deflect and/or align the band-shaped material 101. On the one hand, a lower nozzle floating field 106, which may be formed below the band-shaped material 101, may lift the band-shaped material 101.

The nozzle arrangement 130 may be formed to spray a liquid fluid, such as for example a water mixture or an oil mixture, in the direction towards the band running plane in order to effect a desired temperature-control effect (heating up or cooling down) of the band-shaped material 101. Herein, the nozzle arrangement 130 may spray the liquid fluid with a predetermined volume flow as well as a predetermined fluid temperature in the direction towards the band running plane. The nozzle arrangement 130 may consist of a plurality of nozzle elements, which may be arranged in one or more rows relative to each other, and which rows may extend in the width direction 109 perpendicular to the conveying direction 103.

The nozzle arrangement 130 may be formed such that the fluid jet 131 may be flowable into the front gas jet 111 and/or into the nozzle floating field 106, in particular before the front gas jet 111 may impinge on the band-shaped material 101. In other words, the front gas jet 111 and the fluid jet 131 may be formed relative to each other such that the liquid fluid may be mixed with the gas in the front gas jet 111 before the liquid fluid and the gas may impinge on the band-shaped material 101. In another exemplary embodiment, the nozzle arrangement may be arranged such that the fluid jet may be adjustable into the rear gas jet 121.

The nozzle arrangement 130 may be arranged such that the fluid jet 131 may form an angle $\alpha$ between 30° and 45° relative to the conveying direction 101. Thus, the liquid fluid may be applied onto the band-shaped material 101 in particular against the conveying direction 103. The front gas nozzle arrangement 110 may be arranged such that the front gas jet 111 may form an angle $\beta$ between 45° and 70° to the conveying direction 103. Thus, the gas may be applied onto the band-shaped material 101 against the conveying direction 103. It has turned out that, with the indicated values, a robust nozzle floating field 106 may be formed in an advantageous manner, and at the same time the liquid fluid may be dispatched (or dissipated) speedily and completely.

As can be seen in FIG. 1, the nozzle arrangement 130 and the gas nozzle arrangement 110 may be formed relative to each other such that an angle $\beta$ between the front gas jet 111 and the conveying direction 103 may be larger than an angle $\alpha$ between the fluid jet 131 and the conveying direction 103. In other words, the fluid jet 130 of the liquid fluid may impinge more flatly (or shallower) onto the surface of the material 101 than the gas jet 111. This may result in that a better and/or more laminar (or more areal) contact may be generated between the liquid fluid and the material, and at the same time a more robust nozzle floating field 106 may be generated due to the steeper spraying angle of the gas jet.

The rear gas nozzle arrangement 120 may be arranged such that the rear gas jet 121 may form an angle $\gamma$ between 110° and 135° relative to the conveying direction 103. Thus, the gas may be applied onto the band-shaped material 101 in particular in the conveying direction 103. It has turned out that, with the indicated values, a robust nozzle floating field 106 may be formed in an advantageous manner, and at the same time the liquid fluid may be dispatched speedily and completely.

The nozzle arrangement 130 may be arranged adjustable at the nozzle body 102 such that the angle $\alpha$ between the fluid jet 131 and the conveying direction 103 may be adjustable. In the represented embodiment example, the nozzle arrangement 130 may be arranged rotatably (or pivotably) at the nozzle body 102 by a hinge (or articulation) as an adjustment device 108. Herein, the nozzle arrangement 130 may be rotatable in particular around a rotation axis, which may be formed perpendicular to the conveying direction 103 along the width direction 109 of the band-shaped material 101. As a function of the adjusted spraying angle $\alpha$ of the liquid fluid, the temperature-control effect thereof and the formation behaviour of droplets on the band-shaped material 101 may be adjusted.

The nozzle body 102 may further have, between the front edge region 104 and the rear edge region 105, a perforated metal sheet 107, through which a gaseous fluid may be flowable in the direction towards the band running plane. Herein, the gaseous fluid may be flown through the perforated metal sheet 107 almost perpendicular onto the band-shaped material 101. This may result in a formation of a robust nozzle floating field 106.

Figure 2:
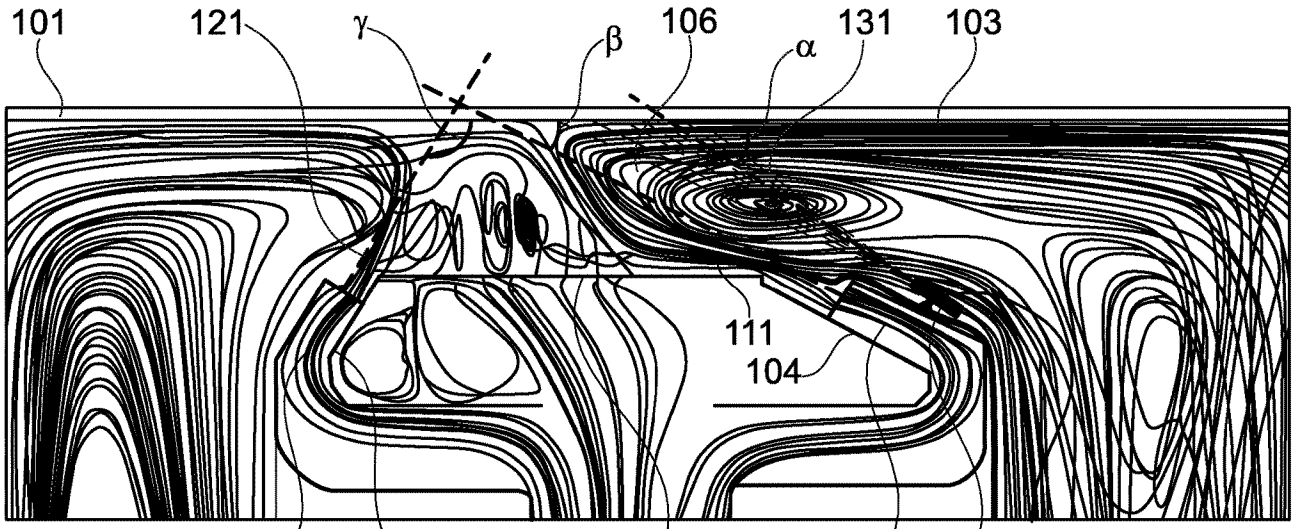
FIG. 2 shows a schematic illustration of a nozzle system from FIG. 1, in which flow lines can be seen, according to an exemplary embodiment of the present invention.

FIG. 2 shows a schematic illustration of the nozzle system 100 from FIG. 1, in which flow lines of the gas and of the liquid fluid can be seen. The fluid jet 131 may be flown-out by the nozzle arrangement 130 in the direction towards the band-shaped material 101, such that the fluid jet 131 may impinge onto the band-shaped material 101 with the angle $\alpha$. Accordingly, the front gas jet 111 may be flown-out in the direction towards the band-shaped material 101 such that the front gas jet 111 may impinge onto the band-shaped material 101 with the angle $\beta$. In the illustrated embodiment example, the angle $\alpha$ may be formed larger than the angle $\beta$. The relation between the two angles $\alpha$, $\beta$ may be adjusted via the adjustable nozzle arrangement 130.

As is illustrated in FIG. 2, the front gas jet 111 may be flown onto the band-shaped material 101 against the conveying direction 103. Due to the conveying direction 103 and due to the flowing-out direction of the rear gas jet 121 of the rear gas nozzle arrangement 120 with the angle $\gamma$ in the direction of the conveying direction 103, the front gas jet 101 may be deflected in the conveying direction 103. This deflection may result in the formation of an eddy in the area of the front edge region 104 of the nozzle body 102. Thereby, the liquid fluid of the fluid jet 131 may also be whirled (or swirled), which in turn may result in an improved atomization (or spraying) of the liquid fluid as well as in a better dissipation.

Figure 3:
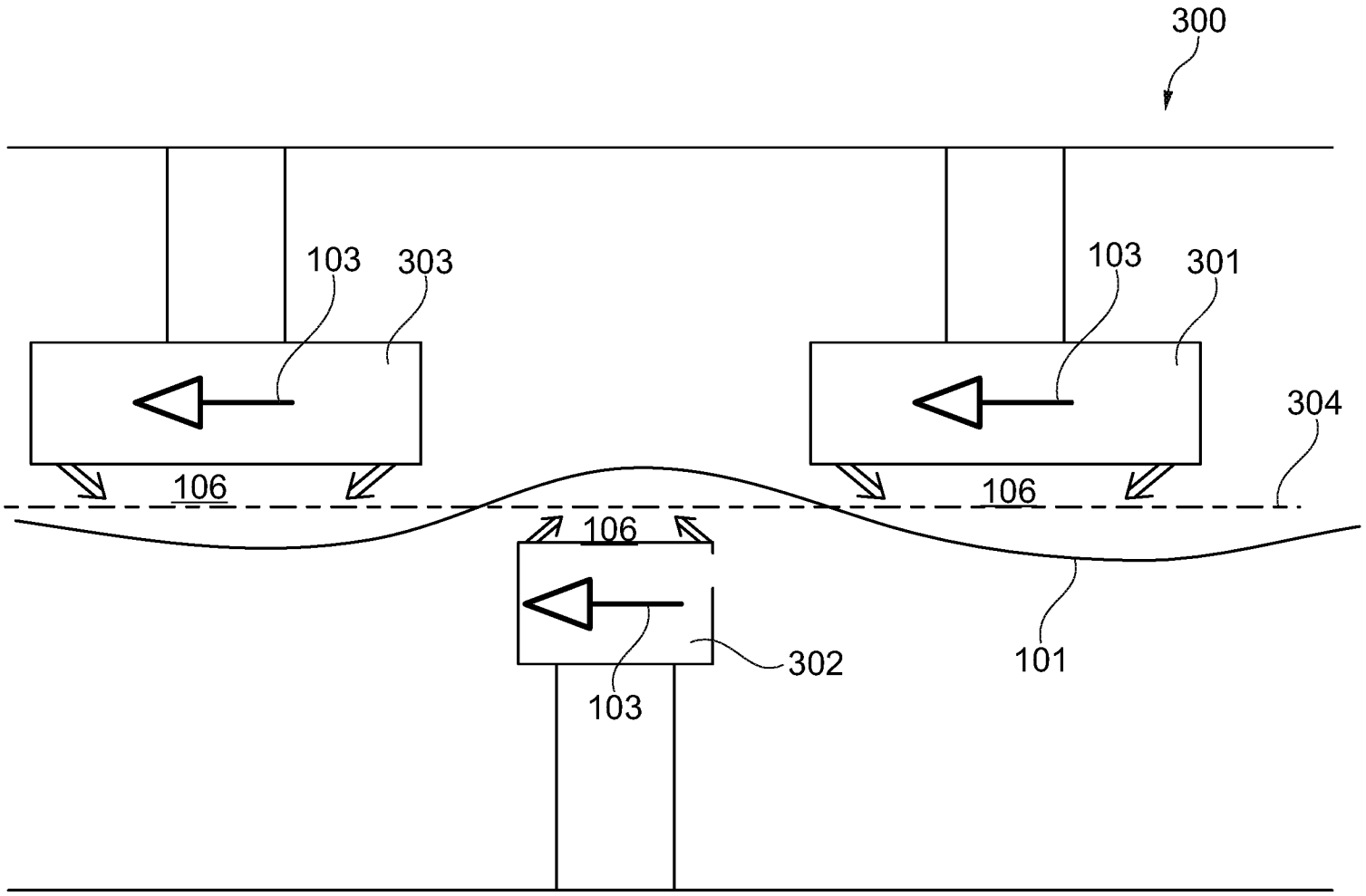
FIG. 3 shows a schematic illustration of a band floating system having nozzle systems according to an exemplary embodiment of the present invention.

FIG. 3 shows a schematic illustration of a band floating system 300 having nozzle systems 301, 302, 303 according to an exemplary embodiment of the present invention.

In the band floating system 300, the band-shaped material 101 may be conveyed almost contactlessly, such that locations of contact may be reduced. In particular, this may be generated by the generation of the nozzle floating fields 106 by the corresponding gas nozzle arrangements of the nozzle systems 301, 302, 303. In the present example, the band floating system 300 may have three nozzle systems 301, 302, 303, which may be formed according to the embodiment in FIG. 1 and FIG. 2. The first nozzle system 301 and the third nozzle system 303 may be arranged relative to the second nozzle system 302 such that the band-shaped material 101 may be guidable between the first and third nozzle systems 301, 303 and the second nozzle system 302. Thus, a nozzle floating field 106 may impact (or affect) the band-shaped material 101 from both sides, i.e. from below and from above, such that a robust and precise guiding may be enabled. Furthermore, a precise temperature-controlling may be provided on both sides of the band-shaped material 101.

The nozzle systems 301, 302, 303 may herein be arranged, in the conveying direction 103, located at a distance relative to each other. Furthermore, the nozzle systems 301, 302, 303 may be arranged, in the conveying direction 103, alternatingly above and below the band-shaped material 101. Thus, a wave-like (sinus-shaped) course (or progression) of the band-shaped material 101 along the conveying direction 103 may be generated. As is illustrated in FIG. 3, respectively alternatingly in the conveying direction 103, one nozzle floating field 106 may lift the band-shaped material 101, while a subsequent nozzle floating field 106 may press the band-shaped material 101 in the gravitation direction. Thus, the wave-like course of the band-shaped material 101 may be generated selectively (or targetedly) in the longitudinal direction and/or in the conveying direction 103. The formation of a wave-like course of the band-shaped material may result in an increased stability against a bending along the width direction 109 of the band-shaped material.

Supplementarily, it is to be noted that "having" (or "comprising") does not exclude other elements or steps, and that "a" or "an" does not exclude a plurality. Furthermore, it is noted that features or steps, which have been described with reference to one of the above embodiment examples, can also be used in combination with other features or steps of other embodiment examples described above. Reference numerals in the claims are not to be considered as limitations.

LIST OF REFERENCE NUMERALS

100 nozzle system
101 band-shaped material
102 nozzle body
103 conveying direction
104 front edge region
105 rear edge region
106 nozzle floating field
107 perforated metal sheet
108 adjustment device
109 width of the band-shaped material
110 front gas jet arrangement
111 front gas jet
120 rear gas nozzle arrangement
121 rear gas jet
130 nozzle arrangement
131 fluid jet
300 band floating system
301 nozzle system
302 nozzle system
303 nozzle system
304 middle track

The invention claimed is:

1. Nozzle system for a band floating system for floatingly guiding a band-shaped material, the nozzle system having a nozzle body, which has, along a conveying direction of the band-shaped material, which is conveyable within a band running plane, a front edge area and a rear edge area opposite to the front edge area, a front gas nozzle arrangement, which is arranged at the front edge area such that a front gas jet is flowable in the direction towards the band running plane for forming a nozzle floating field for the band-shaped material, a rear gas nozzle arrangement, which is arranged at the rear edge area such that a rear gas jet is flowable in the direction towards the band running plane for forming the nozzle floating field for the band-shaped material, a nozzle arrangement, which is arranged, in the conveying direction, in front of the front gas nozzle arrangement and/or behind the rear gas nozzle arrangement, wherein the nozzle arrangement is configured such that a liquid fluid is flowable in a fluid jet into the nozzle floating field in the direction towards the band running plane for temperature-controlling the band-shaped material, and wherein between the nozzle arrangement there is no nozzle arrangement for flowing out the liquid fluid, and wherein the nozzle arrangement is arranged such that the fluid jet is flowable into the front gas jet or the rear gas jet, or wherein the nozzle body has, between the front edge area and the rear edge area, a perforated metal plate, through which a gaseous fluid is flowable in the direction towards the band running plane.

2. Nozzle system according to claim 1, wherein the nozzle arrangement is arranged such that the fluid jet forms an angle, $\alpha$, between 20° and 85°, relative to the conveying direction.

3. Nozzle system according to claim 1, wherein the front gas nozzle arrangement is arranged such that the front gas jet forms an angle, $\beta$, between 30° and 85°, relative to the conveying direction.

4. Nozzle system according to claim 1, wherein an angle, $\beta$, between the front gas jet and the conveying direction is larger than an angle, $\alpha$, between the fluid jet and the conveying direction.

5. Nozzle system according to claim 1, wherein the rear gas nozzle arrangement is arranged such that the rear gas jet forms an angle, $\gamma$, between 90° and 145°, relative to the conveying direction.

6. Nozzle system according to claim 1, wherein the nozzle arrangement is arranged adjustably at the nozzle body such that an angle, $\alpha$, between the fluid jet and the conveying direction is adjustable.

7. Nozzle system according to claim 1, wherein the front gas nozzle arrangement and/or the rear gas nozzle arrangement is formed as a slot nozzle, which extends perpendicular to the conveying direction.

8. Nozzle system according to claim 1, wherein the nozzle arrangement has a plurality of nozzles, which are arranged one after another along a width of the nozzle body perpendicular to the conveying direction.

9. Nozzle system according to claim 1, further having a further nozzle arrangement, which is arranged, in the conveying direction, behind the rear gas nozzle arrangement, wherein the further nozzle arrangement is configured such that a liquid fluid is flowable in a further fluid jet in the direction towards the band running plane for temperature-controlling the band-shaped material.

10. Band floating system for floatingly guiding a band-shaped material, the band floating system having a first nozzle system according to claim 1, a second nozzle system according to claim 1, wherein the first nozzle system is arranged relative to the second nozzle system such that the band-shaped material is guidable between the first nozzle system and the second nozzle system.

11. Band floating system according to claim 10, wherein the first nozzle system is arranged, in the conveying direction, located at a distance from the second nozzle system.

12. Band floating system according to claim 11, wherein the first nozzle system and the second nozzle system are configurable such that by a nozzle floating field of the first nozzle system and a nozzle floating field of the second nozzle system a course of the band-shaped material along the conveying direction is generatable in the form of a wave.

13. Method for floatingly guiding a band-shaped material, the method having guiding the band-shaped material along a conveying direction within a band running plane, wherein a nozzle body has, along a conveying direction, a front edge area and a rear edge area opposite to the front edge area, flowing a front gas jet in the direction towards the band running plane for forming a nozzle floating field for the band-shaped material by a front gas nozzle arrangement, which is arranged at the front edge area, flowing a rear gas jet in the direction towards the band running plane for forming the nozzle floating field for the band-shaped material by a rear gas nozzle arrangement, which is arranged at the rear edge area, flowing a fluid jet in the direction towards the band running plane into the nozzle floating field for temperature-controlling the band-shaped material by a nozzle arrangement, which is arranged in the conveying direction in front of the front gas nozzle arrangement or behind the rear gas nozzle arrangement, wherein the nozzle arrangement is configured such that a liquid fluid is flowable in the fluid jet into the nozzle floating field, and wherein between the nozzle arrangement there is no nozzle arrangement for flowing out the liquid fluid, and wherein the nozzle arrangement is arranged such that the fluid jet is flowable into the front gas jet or the rear gas jet, or wherein the nozzle body has, between the front edge area and the rear edge area, perforated metal plate, through which a gaseous fluid is flowable in the direction towards the band running plane.

* * * * *